US011699407B2

(12) United States Patent
Zhang et al.

(10) Patent No.: US 11,699,407 B2
(45) Date of Patent: Jul. 11, 2023

(54) DISPLAY DEVICE DRIVING METHOD AND DISPLAY DEVICE

(71) Applicant: TCL CHINA STAR OPTOELECTRONICS TECHNOLOGY CO., LTD., Shenzhen (CN)

(72) Inventors: Xin Zhang, Shenzhen (CN); Dan Cao, Shenzhen (CN); Tao He, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 532 days.

(21) Appl. No.: 16/962,409

(22) PCT Filed: May 18, 2020

(86) PCT No.: PCT/CN2020/090773
§ 371 (c)(1),
(2) Date: Jul. 15, 2020

(87) PCT Pub. No.: WO2021/217743
PCT Pub. Date: Nov. 4, 2021

(65) Prior Publication Data

US 2023/0090936 A1 Mar. 23, 2023

(30) Foreign Application Priority Data

Apr. 28, 2020 (CN) ..... 202010348135.2

(51) Int. Cl.
*G09G 3/36* (2006.01)
*G09G 3/34* (2006.01)

(52) U.S. Cl.
CPC ..... *G09G 3/36* (2013.01); *G09G 3/3426* (2013.01); *G09G 2320/066* (2013.01); *G09G 2320/0626* (2013.01); *G09G 2360/16* (2013.01)

(58) Field of Classification Search
CPC .. G09G 3/3688; G09G 5/026; G09G 2360/16; G09G 2360/145;
(Continued)

(56) References Cited

U.S. PATENT DOCUMENTS

2008/0143757 A1* 6/2008 Furihata ..... G09G 3/3406 345/102
2009/0109232 A1* 4/2009 Kerofsky ..... G09G 3/3406 345/589
(Continued)

FOREIGN PATENT DOCUMENTS

CN 101673520 A 3/2010
CN 101826282 A 9/2010
(Continued)

*Primary Examiner* — Shaheda A Abdin
(74) *Attorney, Agent, or Firm* — PV IP PC; Wei Te Chung; Zhigang Ma

(57) ABSTRACT

A display device driving method and the display device are provided. The display device driving method determines a driving voltage value of each backlight unit based on a content to be displayed by a display unit corresponding to each backlight unit, achieving dynamic adjustment of luminous brightness of the backlight unit according to the display content of the corresponding display unit. Meanwhile, the driving voltage value is related to a noise in an image. Therefore, a better backlight brightness value can be obtained by reducing an influence of the noise on the adjustment of the luminous brightness.

16 Claims, 6 Drawing Sheets

(58) Field of Classification Search
CPC ... G09G 2320/0666; G09G 2320/0646; G09G 2320/0633; G09G 3/2092; G09G 3/3648
See application file for complete search history.

(56) References Cited

U.S. PATENT DOCUMENTS

| | | | | |
|---|---|---|---|---|
| 2009/0224678 | A1 | 9/2009 | Wang | |
| 2011/0157257 | A1* | 6/2011 | Bennett | H04N 13/315 345/690 |
| 2012/0001947 | A1* | 1/2012 | Chu-Ke | G09G 3/3406 345/690 |
| 2016/0173862 | A1* | 6/2016 | Huang | G09G 3/2007 348/51 |

FOREIGN PATENT DOCUMENTS

| | | | |
|---|---|---|---|
| CN | 102498508 | A | 6/2012 |
| CN | 104934015 | A | 9/2015 |
| CN | 108806616 | A | 11/2018 |

* cited by examiner

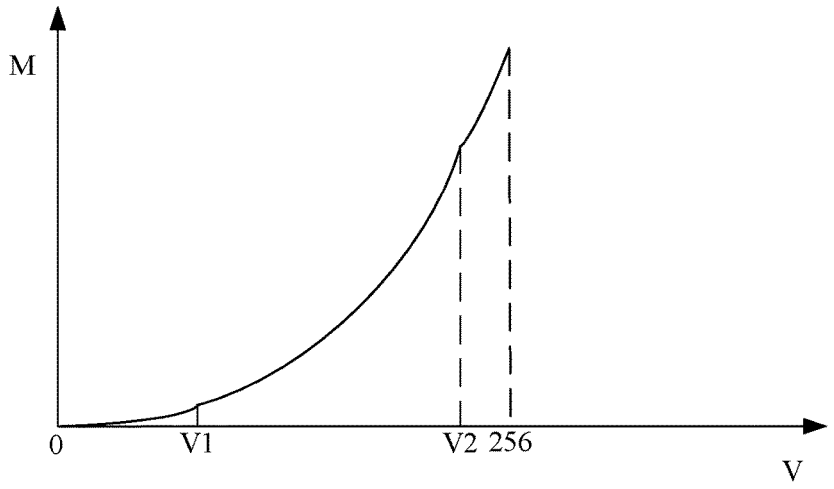
FIG. 4a
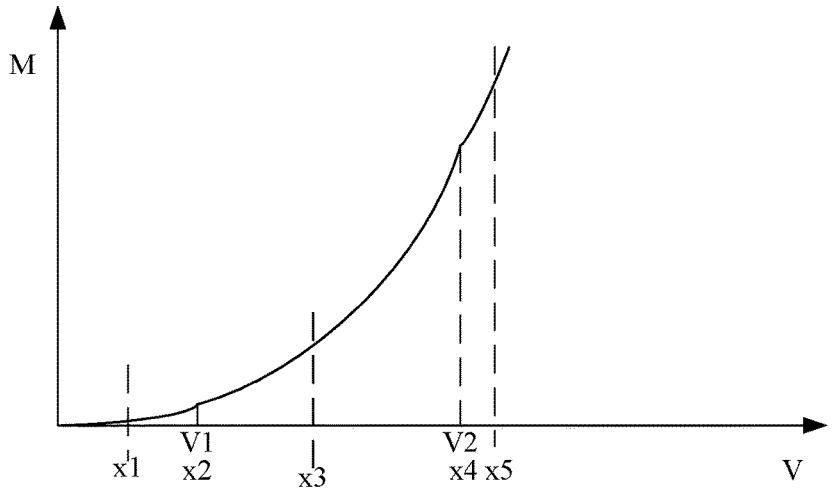
FIG. 4b
| | | | | | | | | | |
|---|---|---|---|---|---|---|---|---|---|
| R-1-i-Z | R-1-i-Y | R-2-i-Z | R-2-i-Y | R-3-i-Z | R-3-i-Y | …… | …… | B-5-i-Z | B-5-i-Y |
FIG. 4c

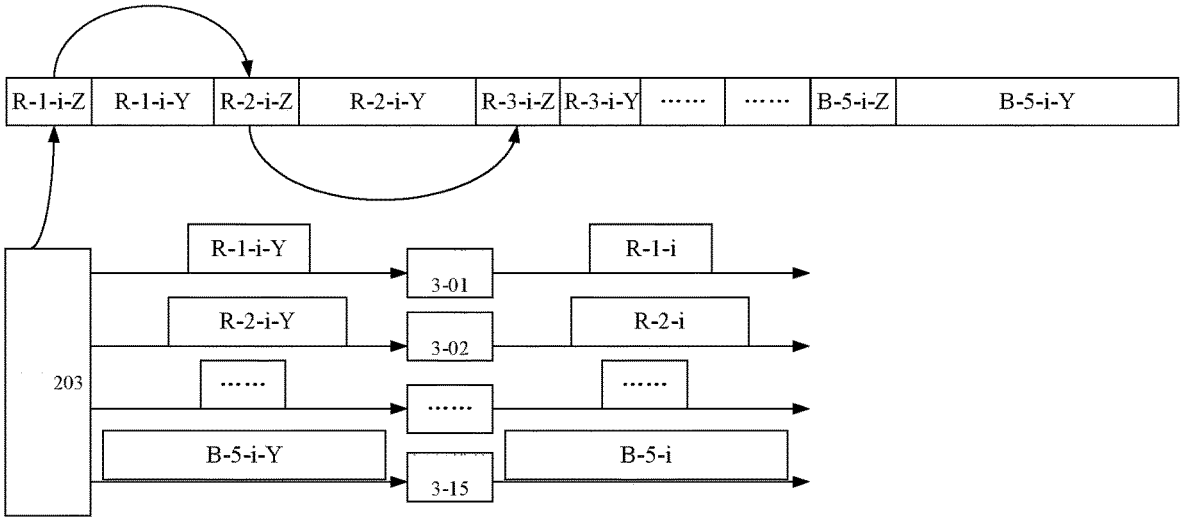
FIG. 4d
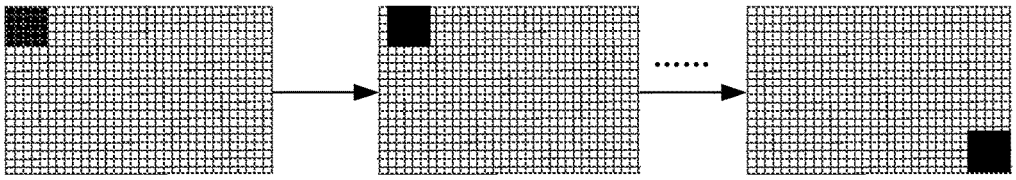
FIG. 5a
$$f(L_{block_n}) = \begin{cases} 1 & (L_{block_n} \leq th1, block_n = 0 \sim N) \\ 0 \sim 1 & (th1 < L_{block_n} < th2, block_n = 0 \sim N) \\ 0 & (L_{block_n} \geq th2, block_n = 0 \sim N) \end{cases}$$
FIG. 5b
$$\begin{cases} BL_{val} = (L_{ave} + 0.5 * f(x)) * (1 - ra) + L_{ave} * ra \\ ra = f(L_{block_n}) \\ f(x) = L_{dif} + \frac{L_{dif}^2}{255} \\ L_{dif} = L_{max} - L_{ave} \end{cases}$$
FIG. 5c

DISPLAY DEVICE DRIVING METHOD AND DISPLAY DEVICE

FIELD OF INVENTION

The present disclosure relates to the field of display technology, and more particularly, to a display device driving method and the display device.

BACKGROUND OF INVENTION

With improvement of display device resolution, users have more and more requirements for display device contrast. Due to a phenomenon of dark-state light leakage in liquid crystal display panels, this causes display devices using the liquid crystal display panels to have a low contrast in general.

SUMMARY OF INVENTION

The present disclosure provides a display device driving method and the display device to improve a contrast of the display device which using a liquid crystal display panel.

To solve the above problems, the technical solutions provided by the present disclosure are as follows:

One embodiment of the present disclosure provides a display device driving method, wherein the display device includes a backlight module, a liquid crystal display panel, and a main control chip, the backlight module comprises a first driving chip, the liquid crystal display panel comprises a second driving chip; a backlight source of the backlight module comprises a plurality of backlight units arranged in an array and a driving circuit corresponding to each of the backlight units, the liquid crystal display panel comprises a plurality of display units arranged in an array, each of the display units comprises a plurality of pixels, the plurality of backlight units are in a one-to-one correspondence with the plurality of display units, and the display device driving method includes:

the main control chip acquiring a brightness data of each of the pixels of a target display unit when displaying a target display frame, determining a noise data of an image to be displayed of the target display unit when displaying the target display frame according to the brightness data of each of the pixels of the target display unit, and determining a target brightness value of the target backlight unit corresponding to the target display unit when displaying the target display frame according to the brightness data of each of the pixels of a target display unit and the noise data of the image to be displayed of the target display unit;

the main control chip determining a driving voltage value of the target backlight unit when displaying the target display frame according to the target brightness value of the target backlight unit corresponding to the target display unit when displaying the target display frame, and sending the driving voltage value to the first driving chip;

the main control chip determining a driving voltage value of each of the pixels of the target display unit when displaying the target display frame according the brightness data of each of the pixels of a target display unit when displaying a target display frame, and sending to the second driving chip;

the first driving chip driving each of the backlight units of the backlight module to emit light according to the driving voltage value of the target backlight unit when displaying the target display frame; and the second driving chip driving each of the pixels of each of the display units of the liquid crystal display panel to transmit light according to the driving voltage value of each of the pixels of the target display unit when displaying the target display frame.

In the display device driving method provided by the embodiment of the present disclosure, the step of the step of determining the noise data of the image to be displayed of the target display unit when displaying the target display frame according to the brightness data of each of the pixels of the target display unit including:

sequentially traversing each of the pixels of the target display unit according to traversal parameters to obtain a plurality of traversal blocks;

determining a total brightness value of all of the pixels of each of the traversal blocks according to the brightness data of each of the pixels of the target display unit; and determining the noise data of the image to be displayed of the target display unit when displaying the target display frame according to the determining method of the noise data corresponding to the target display unit and the total brightness value of all of the pixels of each of the traversal blocks.

In the display device driving method provided by the embodiment of the present disclosure, before the step of determining the noise data of the image to be displayed of the target display unit when displaying the target display frame according to the determining method of the noise data corresponding to the target display unit and the total brightness value of all of the pixels of each of the traversal blocks includes:

determining an average brightness value of the plurality of pixels of the target display unit according to the brightness data of each of the pixels of the target display unit;

determining a threshold parameter corresponding to the target display unit according to the average brightness value of the plurality of pixels of the target display unit; and obtaining the determining method of the noise data corresponding to the target display unit according to a preset determining method of the noise data corresponding to the target display unit and the threshold parameter corresponding to the target display unit.

In the display device driving method provided by the embodiment of the present disclosure, the step of determining the noise data of the image to be displayed of the target display unit when displaying the target display frame according to the determining method of the noise data corresponding to the target display unit and the total brightness value of all of the pixels of each of the traversal blocks further includes:

when a sum of brightness values of all pixels in all traversal blocks is less than a first threshold, setting the noise data of the image to be displayed by the target display unit to a first value;

when the sum of the brightness values of all pixels in any one traversal block is greater than a second threshold, setting the noise data of the image to be displayed by the target display unit to a second value; and when the sum of brightness values of all pixels in all traversal blocks is less than the second threshold, and the sum of brightness values of all pixels in any one traversal block is greater than the first threshold, setting the noise data of the image to be displayed by the target display unit to a third value.

In display device driving method provided by the embodiment of the present disclosure, the step of setting the noise data of the image to be displayed by the target display unit to the third value comprises:

filtering all the traversal blocks to find a target traversal block which the sum of the brightness values of all pixels is less than the second threshold and greater than the first threshold; and determining the third value according to the sum of the brightness values of the target traversal block.

In the display device driving method provided by the embodiment of the present disclosure, the step of setting the noise data of the image to be displayed by the target display unit to the third value comprises:

filtering all the traversal blocks to find a target traversal block which the sum of the brightness values of all pixels is greatest; and determining the third value according to the sum of the brightness values of the target traversal block.

In the display device driving method provided by the embodiment of the present disclosure, the step of determining a target brightness value of the target backlight unit corresponding to the target display unit when displaying the target display frame according to the brightness data of each of the pixels of a target display unit and the noise data of the image to be displayed of the target display unit comprises:

determining an average brightness value and a maximum brightness value of the plurality of pixels of the target display unit according to the brightness data of each of the pixels of the target display unit; and determining the target brightness value of the target backlight unit corresponding to the target display unit when displaying the target display frame according to the average brightness value, the maximum brightness value, and the noise data.

In the display device driving method provided by the embodiment of the present disclosure, the step of determining the target brightness value of the target backlight unit corresponding to the target display unit when displaying the target display frame according to the average brightness value, the maximum brightness value, and the noise data comprises:

determining a compensated brightness value according to the average brightness value and the maximum brightness value; and determining the target brightness value of the target backlight unit corresponding to the target display unit when displaying the target display frame according to the average brightness value, the compensated brightness value, and the noise data.

In the display device driving method provided by the embodiment of the present disclosure, the step of determining the compensated brightness value according to the average brightness value and the maximum brightness value comprises:

determining a brightness difference value according to the average brightness value and the maximum brightness value; and determining the compensated brightness value according to the brightness difference value and a preset compensation method.

In the display device driving method provided by the embodiment of the present disclosure, the main control chip according the brightness data of each of the pixels of a target display unit when displaying a target display frame determining a driving voltage value of each of the pixels of the target display unit when displaying the target display frame, and sending to the second driving chip comprises:

reading a compressed de-marking data stored in a memory in a compressed state and loading it into a random access memory (RAM), the compressed de-marking data comprises de-marking data after compressing for each of the display units, and an identifier data configured to identify locations of each of the de-marking data after compressing;

using at least two decoding modules, based on the identifier data, obtaining an actual de-marking data after compressing of each of the display units in the current display position by the at least two decoding modules in parallel decoding the compressed de-marking data corresponding to a current display position in the RAM; and determining the driving voltage value of each of the pixels of the target display unit when displaying the target display frame, and sending to the second driving chip according to the brightness data of each of the pixels and the actual de-marking data.

One embodiment of the present disclosure further provides a display device, comprising a backlight module, a liquid crystal display panel, and a main control chip, the backlight module comprising a first driving chip, the liquid crystal display panel comprising a second driving chip; a backlight source of the backlight module comprising a plurality of backlight units arranged in an array and a driving circuit corresponding to each of the backlight units, the liquid crystal display panel comprises a plurality of display units arranged in an array, each of the display units comprises a plurality of pixels, the plurality of backlight units are in a one-to-one correspondence with the plurality of display units, wherein:

the main control chip acquiring a brightness data of each of the pixels of a target display unit when displaying a target display frame, determining a noise data of an image to be displayed of the target display unit when displaying the target display frame according to the brightness data of each of the pixels of the target display unit, and determining a target brightness value of the target backlight unit corresponding to the target display unit when displaying the target display frame according to the brightness data of each of the pixels of a target display unit and the noise data of the image to be displayed of the target display unit; determining a driving voltage value of the target backlight unit when displaying the target display frame according to the target brightness value of the target backlight unit corresponding to the target display unit when displaying the target display frame, and sending the driving voltage value to the first driving chip; determining a driving voltage value of each of the pixels of the target display unit when displaying the target display frame according the brightness data of each of the pixels of a target display unit when displaying a target display frame, and sending to the second driving chip;

the first driving chip driving each of the backlight units of the backlight module to emit light according to the driving voltage value of the target backlight unit when displaying the target display frame; and the second driving chip driving each of the pixels of each of the display units of the liquid crystal display panel to transmit light according to the driving voltage value of each of the pixels of the target display unit when displaying the target display frame.

In the display device provided by the embodiment of the present disclosure, the main control chip is configured to:

sequentially traversing each of the pixels of the target display unit according to traversal parameters to obtain a plurality of traversal blocks;

determining a total brightness value of all of the pixels of each of the traversal blocks according to the brightness data of each of the pixels of the target display unit; and determining the noise data of the image to be displayed of the target display unit when displaying the target display frame according to the determining method of the noise data corresponding to the target display unit and the total brightness value of all of the pixels of each of the traversal blocks.

In the display device provided by the embodiment of the present disclosure, the main control chip is configured to:

determining an average brightness value of the plurality of pixels of the target display unit according to the brightness data of each of the pixels of the target display unit;

determining a threshold parameter corresponding to the target display unit according to the average brightness value of the plurality of pixels of the target display unit; and obtaining the determining method of the noise data corresponding to the target display unit according to a preset determining method of the noise data corresponding to the target display unit and the threshold parameter corresponding to the target display unit.

In the display device provided by the embodiment of the present disclosure, the main control chip is configured to:

when a sum of brightness values of all pixels in all traversal blocks is less than a first threshold, setting the noise data of the image to be displayed by the target display unit to a first value;

when the sum of the brightness values of all pixels in any one traversal block is greater than a second threshold, setting the noise data of the image to be displayed by the target display unit to a second value; and when the sum of brightness values of all pixels in all traversal blocks is less than the second threshold, and the sum of brightness values of all pixels in any one traversal block is greater than the first threshold, setting the noise data of the image to be displayed by the target display unit to a third value.

In the display device provided by the embodiment of the present disclosure, the main control chip is configured to:

filtering all the traversal blocks to find a target traversal block which the sum of the brightness values of all pixels is less than the second threshold and greater than the first threshold; and determining the third value according to the sum of the brightness values of the target traversal block.

In the display device provided by the embodiment of the present disclosure, the main control chip is configured to:

filtering all the traversal blocks to find a target traversal block which the sum of the brightness values of all pixels is greatest; and determining the third value according to the sum of the brightness values of the target traversal block.

In the display device provided by the embodiment of the present disclosure, the main control chip is configured to:

determining an average brightness value and a maximum brightness value of the plurality of pixels of the target display unit according to the brightness data of each of the pixels of the target display unit; and determining the target brightness value of the target backlight unit corresponding to the target display unit when displaying the target display frame according to the average brightness value, the maximum brightness value, and the noise data.

In the display device provided by the embodiment of the present disclosure, the main control chip is configured to:

determining a compensated brightness value according to the average brightness value and the maximum brightness value; and determining the target brightness value of the target backlight unit corresponding to the target display unit when displaying the target display frame according to the average brightness value, the compensated brightness value, and the noise data.

In the display device provided by the embodiment of the present disclosure, the main control chip is configured to:

determining a brightness difference value according to the average brightness value and the maximum brightness value; and determining the compensated brightness value according to the brightness difference value and a preset compensation method.

In the display device provided by the embodiment of the present disclosure, the main control chip is configured to:

reading a compressed de-marking data stored in a memory in a compressed state and loading it into a RAM (Random Access Memory), the compressed de-marking data comprises de-marking data after compressing for each of the display units, and an identifier data configured to identify locations of each of the de-marking data after compressing;

using at least two decoding modules, based on the identifier data, obtaining an actual de-marking data after compressing of each of the display units in the current display position by the at least two decoding modules in parallel decoding the compressed de-marking data corresponding to a current display position in the RAM; and determining the driving voltage value of each of the pixels of the target display unit when displaying the target display frame, and sending to the second driving chip according to the brightness data of each of the pixels and the actual de-marking data.

The present disclosure provides a display device driving method and the display device. The display device driving method includes following steps: dividing the backlight into a plurality of independently driven backlight units, and then acquiring a brightness data of each of the pixels of a target display unit when displaying a target display frame, determining a noise data of an image to be displayed of the target display unit when displaying the target display frame according to the brightness data of each of the pixels of the target display unit, and determining a target brightness value of the target backlight unit corresponding to the target display unit when displaying the target display frame according to the brightness data of each of the pixels of a target display unit and the noise data of the image to be displayed of the target display unit, and determining a driving voltage value of the target display unit when displaying the target display frame according to the target brightness value of the target backlight unit corresponding to the target display unit when displaying the target display frame; that is, the display device driving method determines the driving voltage value of each of the backlight units according to the content to be displayed by the display unit corresponding to each of the backlight units, which achieves dynamic adjustment of a luminous brightness of the backlight unit according to the display content of the corresponding display unit. In particular, when the display panel is dark, the backlight can be turned off, which can increase the contrast of the entire display device when displaying the image. The driving voltage value is related to the noise of the image, therefore reducing the influence of noise on the adjustment of the luminous brightness. Thereby, a better backlight brightness value can be obtained, improving the screen display effect while reducing power consumption and saving costs.

DESCRIPTION OF FIGURES

In order to more clearly explain the embodiments or the technical solutions in the prior art, the following will briefly introduce the figures required in the description of the embodiments or the prior art. Obviously, the figures in the following description are only for some embodiments of the present disclosure, those of ordinary skill in the art can obtain other figures based on these figures without any inventive steps.

FIGS. 4*a* to 4*d* are schematic diagrams of decoding configurations of one embodiment of the present disclosure.

FIGS. 5*a* to 5*d* are schematic diagrams of calculation configurations of one embodiment of the present disclosure.

DETAILED DESCRIPTION OF PREFERRED EMBODIMENTS

Figure 1:
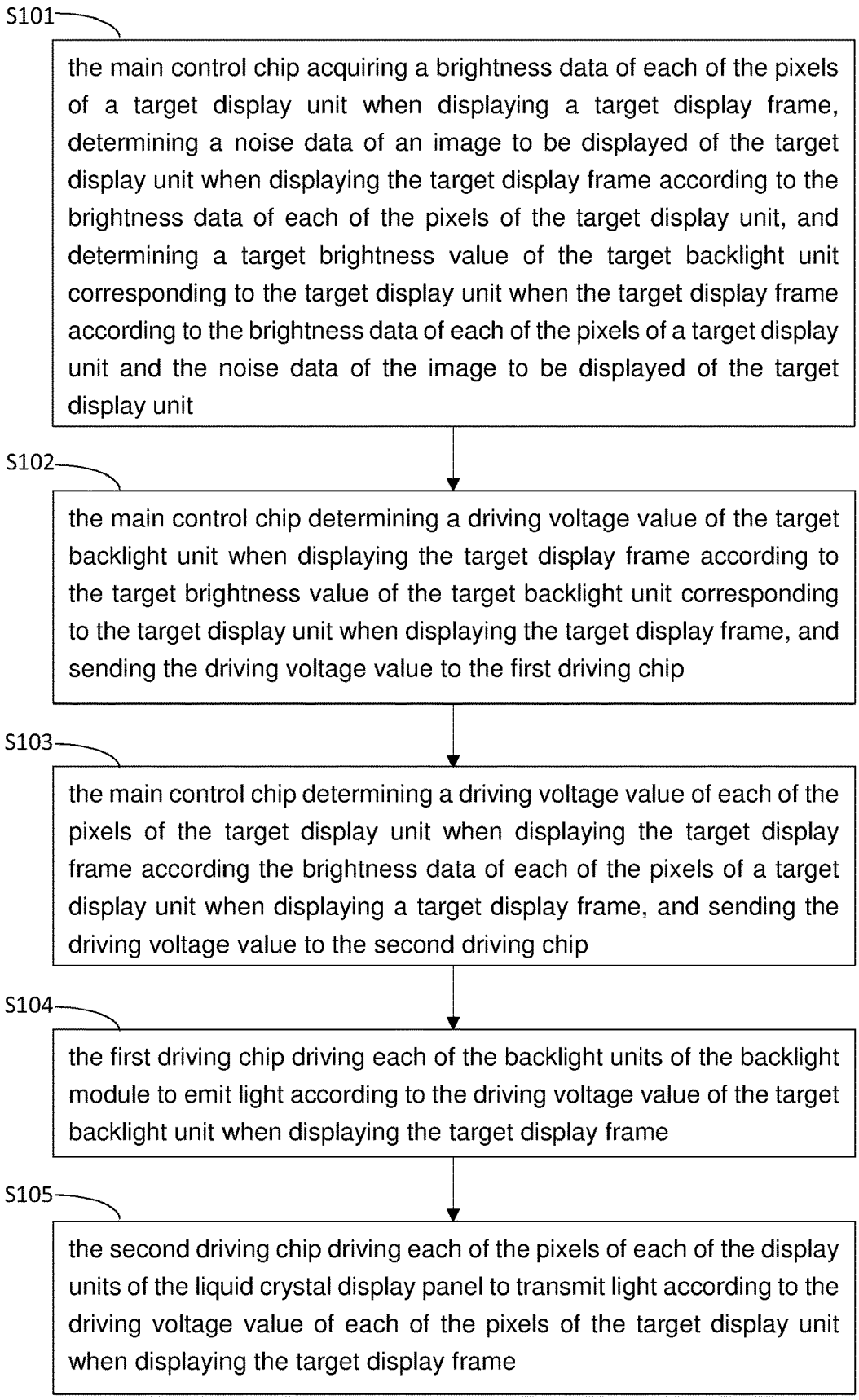
FIG. 1 is a flowchart of a display device driving method of one embodiment of the present disclosure.

The following is a description of each embodiment with reference to additional figures to illustrate specific embodiments in which the present disclosure can be implemented. The directional terms mentioned in the present disclosure, such as up, down, front, back, left, right, inside, outside, side, etc., are only directions referring to the figures. Therefore, the directional terms are to explain and understand the disclosure, not to limit it. In the figure, similarly structured units are denoted by the same reference numerals.

In the present disclosure, a target display frame is a display frame that the display device needs to display and has not yet displayed. Generally, the display frame is determined according to the requirements of to be displayed text or video, etc, which would not be repeatedly disclosed in the present disclosure. In preferably, the target display frame is a next display frame of the current display frame, which can reduce the cost of data storage. In the following, unless otherwise specified, a brightness data, a noise data, a target brightness value of the target backlight unit, a driving voltage value of the target backlight unit (including a first bit-width driving voltage value and a second bit-width driving voltage, etc.), a driving voltage value of each of the pixels, and other parameters are the parameters of the target display frame or the parameters that need to be used in the display device when displaying the target display frame.

In the present disclosure, the brightness data refers to the brightness values of all sub-pixels in each of the pixels in the corresponding display frame, and the noise data refers to a correction coefficient corresponding to the noise in the corresponding display frame; the noise refers to an exponential code camera and other devices that using light as a receiving signal to receive and output a rough part of the image during the process of receiving and outputting the received signal. In other words, the extraneous pixels should not appear in the image, which is usually caused by electronic interference, a smaller size of the noise, and low brightness of the corresponding pixel. An influence on high brightness of the backlight can be ignored when displaying image, but it has a greater influence on low brightness, especially in the dark state. The present disclosure considers this factor.

In the present disclosure, a width of the driving voltage value determined by the main control chip of the display device according to the brightness is generally 8 bits (i.e., a first bit-width), and a width of the light source of the backlight module, such as a bit-width of an actual driving voltage of the LED can be 12 bits, in which case requiring a bit-width conversion.

As shown in FIG. 1, the display device driving method provided by one embodiment of the present disclosure includes:

Step S101: the main control chip acquiring a brightness data of each of the pixels of a target display unit when displaying a target display frame, determining a noise data of an image to be displayed of the target display unit when displaying the target display frame according to the brightness data of each of the pixels of the target display unit, and determining a target brightness value of a target backlight unit corresponding to the target display unit when displaying the target display frame according to the brightness data of each of the pixels of the target display unit and the noise data of the image to be displayed of the target display unit.

In one embodiment, the step of determining the noise data of the image to be displayed of the target display unit when displaying the target display frame according to the brightness data of each of the pixels of the target display unit includes: sequentially traversing each of the pixels of the target display unit according to traversal parameters to obtain a plurality of traversal blocks; determining a total brightness value of all of the pixels of each of the traversal blocks according to the brightness data of each of the pixels of the target display unit; and determining the noise data of the image to be displayed of the target display unit when displaying the target display frame according to the determining method of the noise data corresponding to the target display unit and the total brightness value of all of the pixels of each of the traversal blocks. The traversal parameters can be determined according to the noise in images of different resolutions.

In one embodiment, before the step of determining the noise data of the image to be displayed of the target display unit when displaying the target display frame according to the brightness data of each of the pixels of the target display unit includes: determining an average brightness value of the plurality of pixels of the target display unit according to the brightness data of each of the pixels of the target display unit; determining a threshold parameter corresponding to the target display unit according to the average brightness value of the plurality of pixels of the target display unit; and obtaining the determining method of the noise data corresponding to the target display unit according to a preset determining method of the noise data corresponding to the target display unit and the threshold parameter corresponding to the target display unit.

In one embodiment, the step of determining the noise data of the image to be displayed of the target display unit when displaying the target display frame according to the determining method of the noise data corresponding to the target display unit and the total brightness value of all of the pixels of each of the traversal blocks further includes: when a sum of brightness values of all pixels in all traversal blocks is less than a first threshold, setting the noise data of the image to be displayed by the target display unit to a first value; when the sum of the brightness values of all pixels in any one traversal block is greater than a second threshold, setting the noise data of the image to be displayed by the target display unit to a second value; and when the sum of brightness values of all pixels in all traversal blocks is less than the second threshold, and the sum of brightness values of all pixels in any one traversal block is greater than the first threshold, setting the noise data of the image to be displayed by the target display unit to a third value.

In one embodiment, the step of setting the noise data of the image to be displayed by the target display unit to the third value includes: filtering all the traversal blocks to find a target traversal block which the sum of the brightness values of all pixels is less than the second threshold and greater than the first threshold; and determining the third value according to the sum of the brightness values of the target traversal block.

In one embodiment, the step of setting the noise data of the image to be displayed by the target display unit to the third value includes: filtering all the traversal blocks to find a target traversal block which the sum of the brightness values of all pixels is greatest; and determining the third value according to the sum of the brightness values of the target traversal block.

In one embodiment, the step of determining a target brightness value of the target backlight unit corresponding to the target display unit when displaying the target display frame according to the brightness data of each of the pixels of a target display unit and the noise data of the image to be displayed of the target display unit includes: determining an average brightness value and a maximum brightness value of the plurality of pixels of the target display unit according to the brightness data of each of the pixels of the target display unit; and determining the target brightness value of the target backlight unit corresponding to the target display unit when displaying the target display frame according to the average brightness value, the maximum brightness value, and the noise data.

In one embodiment, the step of determining the target brightness value of the target backlight unit corresponding to the target display unit when displaying the target display frame according to the average brightness value, the maximum brightness value, and the noise data includes: determining a compensated brightness value; and according to the average brightness value, the compensated brightness value, and the noise data according to the average brightness value and the maximum brightness value, determining the target brightness value of the target backlight unit corresponding to the target display unit when display the target display frame.

In one embodiment, the step of determining the compensated brightness value according to the average brightness value and the maximum brightness value includes: determining a brightness difference value according to the average brightness value and the maximum brightness value; and determining the compensated brightness value according to the brightness difference value and a preset compensation method.

The specific implementation scenario of steps will be described below.

Step S102: the main control chip determining a driving voltage value of the target backlight unit when displaying the target display frame according to the target brightness value of the target backlight unit corresponding to the target display unit when displaying the target display frame, and sending the driving voltage value to the first driving chip.

In one embodiment, this step includes: determining a first bit-width driving voltage value of the target display unit when displaying the target display frame according to the target brightness value of the target backlight unit corresponding to the target display unit when displaying the target display frame, determining the second bit-width driving voltage value and sent it to the first driving chip according to a driving voltage conversion relationship table based on brightness values of the first bit-width driving voltage value and a second bit-width driving voltage value.

In one embodiment, determining the second bit-width driving voltage value includes: calling the driving voltage conversion relationship table according to a driving voltage conversion relationship table based on brightness values of the first bit-width driving voltage value and a second bit-width driving voltage value; converting the first bit-width driving voltage value of the target backlight unit during the target display frame into the second bit-width driving voltage value of the target backlight unit during the target display frame according to a correspondence between the first bit-width driving voltage value and the second bit-width driving voltage value in the driving voltage conversion relationship table.

In one embodiment, before the step of calling the driving voltage conversion relationship table, the display device driving method further includes: acquiring a correspondence between the light-emission brightness value of the backlight unit and the second bit-width driving voltage value; acquiring a gamma curve, wherein the gamma curve includes a corresponding change curve of the first bit-width driving voltage value and the brightness value; and generating the driving voltage conversion relationship table based on the brightness value according to the gamma curve and a correspondence relationship between the light-emitting brightness value and the second bit-width driving voltage value of the backlight unit.

In one embodiment, the step of generating the driving voltage conversion relationship table based on the brightness value according to the gamma curve and a correspondence relationship between the light-emitting brightness value and the second bit-width driving voltage value of the backlight unit, includes: obtaining a brightness value of each first bit-width driving voltage value according to the gamma curve; determining a luminous brightness value matching the brightness values corresponding to each first bit-width driving voltage value according to the brightness value of each first bit-width driving voltage value in the correspondence of the light emission brightness value of the backlight unit and the second bit-width driving voltage value; determining a correspondence between the first bit-width driving voltage value and the second bit-width driving voltage value; and obtaining the driving voltage conversion relationship table.

In one embodiment, before the step of acquiring a brightness data of each of the pixels of a target display unit when displaying a target display frame, further includes: the main control chip acquiring a bit-width value of the driving voltage value of the liquid crystal display panel; at the same time when the bit-width value of the driving voltage value of the liquid crystal display panel is the same as the bit-width value of the second bit-width driving voltage value, determining the second bit-width driving voltage value of the target backlight unit during the target display frame according to the driving voltage conversion relationship table of the first bit-width driving voltage value and the second bit-width driving voltage value based on the brightness value; when the bit-width values of the driving voltage value of the liquid crystal display panel and the first bit-width driving voltage value are the same, determining the second bit-width driving voltage value of the target backlight unit during the target display frame according to the bit-width data conversion table.

Step S103: the main control chip determining a driving voltage value of each of the pixels of the target display unit when displaying the target display frame according the brightness data of each of the pixels of a target display unit when displaying a target display frame, and sending the driving voltage value to the second driving chip.

In one embodiment, this step includes: reading a compressed de-marking data stored in a memory in a compressed state and loading it into a random access memory (RAM), the compressed de-marking data comprises de-marking data after compressing for each of the display units, and an identifier data configured to identify locations of each of the de-marking data after compressing; using at least two decoding modules, based on the identifier data, obtaining an actual de-marking data after compressing of each of the display units in the current display position by the at least two decoding modules in parallel decoding the compressed de-marking data corresponding to a current display position in the RAM; and determining the driving voltage value of each of the pixels of the target display unit when displaying the target display frame according to the brightness data of each of the pixels and the actual de-marking data, and sending to the second driving chip.

Step S104: the first driving chip driving each of the backlight units of the backlight module to emit light according to the driving voltage value of the target backlight unit when displaying the target display frame.

Step S105: the second driving chip driving each of the pixels of each of the display units of the liquid crystal display panel to transmit light according to the driving voltage value of each of the pixels of the target display unit when displaying the target display frame.

Figure 3:
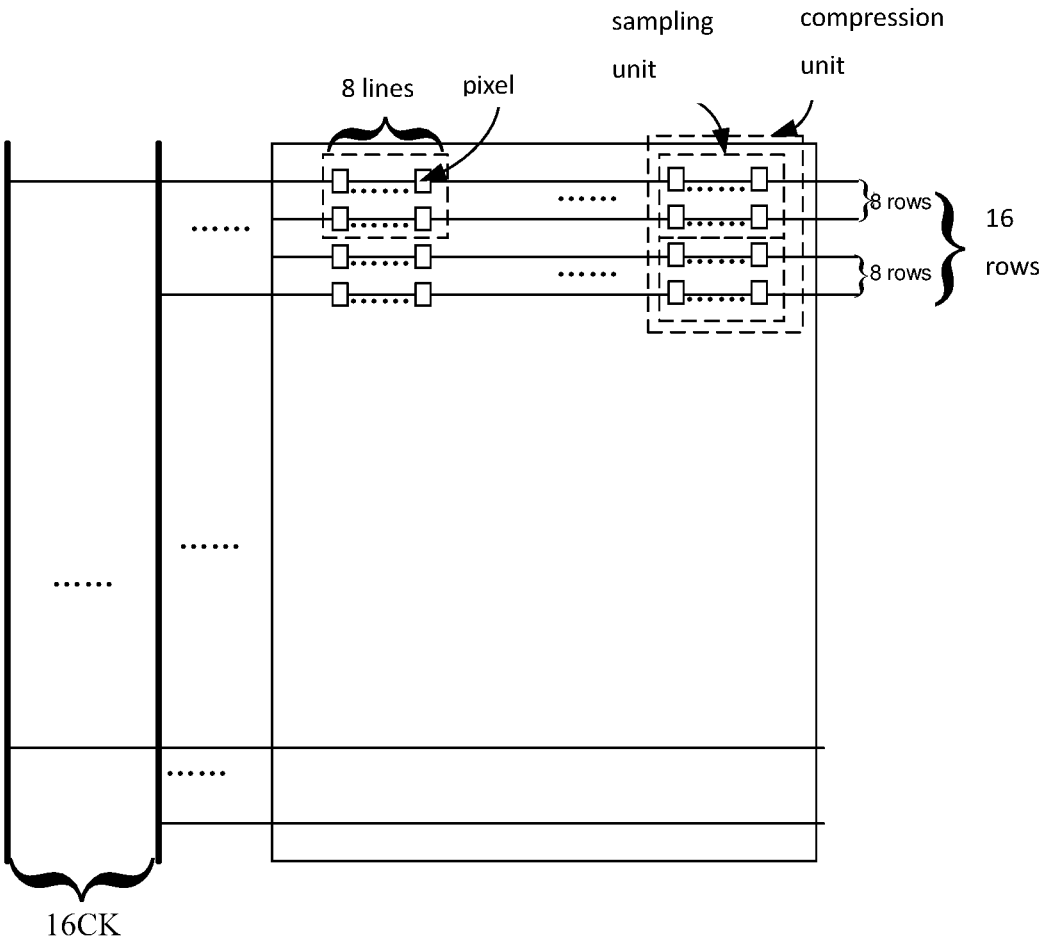
FIG. 3 is a schematic diagram of connection of the display panel of one embodiment of the present disclosure.

In one embodiment, the display panel includes display units arranged in an array, and the display unit includes at least one of pixel units. Current demura technology is processing for each of the pixels of the display panel; that is, each of the pixels corresponds to one demura value, as the resolution of the display panel increases, resulting in larger occupation of a storage space. Based on this, as shown in FIG. 3, the present disclosure uses down-sampling technology to set the two concepts of a sampling unit and a compression unit. A size of the sampling unit (the number of pixels included) can be set according to requirement. The present disclosure focuses on an 8K (resolution is 7680*4320) HD display panel, setting a size of the sampling unit to 8*8 (8 columns by 8 rows), each of the sampling units includes 64 pixels, these 64 pixels adopt the same demura value, so that the amount of demura data corresponding to the entire display panel can be directly reduced to one-64th. In the pixel driving direction and driving sequence, the compression unit includes multiple sampling units, as shown in FIG. 3, the present disclosure provides a 16CK (clock signal line) GOA driving circuit in the 8K display panel, displaying images in each of the display frames in order from top to bottom, and each time scanning driving 16 rows of pixels. A size of the compression unit is 32*2 (32 columns by 2 rows), a total of 64 sampling units, each display position (that is, 16 rows of pixels) includes 30 (that is, 7680÷32÷8) compression units, then each display position corresponds to the compressed de-marking data includes compressed de-marking data corresponding to 30 compression units, and the compressed de-marking data corresponding to each compression unit includes compressed de-marking data corresponding to 64 sampling units. For ease of understanding, the present disclosure treats the display unit and the compression unit equivalently, that is, the plurality of display units in a one-to-one correspondence with the plurality of compression units.

In one embodiment, the pixels described in the present disclosure may refer to pixels with a true RGB structure, that is, in the same row of pixels, red sub-pixels, green sub-pixels, and blue sub-pixels are sequentially arranged in sequence, so that it is necessary to provide corresponding demura values for these three color sub-pixels to the sampling unit. Of course, in other foreseeable embodiments based on the present disclosure, the pixels may be formed by arranging 4 types of sub-pixels of red, green, blue, and white subpixels (RGBW) in array, and may also realized by multiplexing subpixels. In some other foreseeable embodiments, the same demura value may be adopted in three different color sub-pixels, or the same demura value may be adopted in two different color sub-pixels.

In one embodiment, as shown in FIG. 4*a*, a relationship between the driving voltage V (that is, gray-scale voltage) of the pixel and the output light brightness M approximates an exponential function, which is called a gamma curve. Even if an error occurs in the manufacturing process, a relationship between a driving voltage V (that is, gray-scale voltage) of the sub-pixels and the light output brightness M is also an approximate exponential function, only the value of the exponent is different; if calculating the demura value corresponding to different driving voltages by the exponential function, the data is more complicated. For this reason, the original function conversion introduced in the present disclosure converts the exponential function approximately into a combination of a linear function and a quadratic function, which is convenient for calculating the demura values corresponding to different driving voltages V.

Still referring to the 8K display panel as an example, the driving voltage is grayscale 0-1023, for a total of 1024 levels, and the gamma curve in a low grayscale area (0-V1) and a high grayscale area (V2-1023) approximates a straight line, in the middle grayscale area (V1-V2) gamma curve approximates a parabola, and the gray-scale voltages V1 and V2 can be determined according to the actual conditions of each of the pixels in each of sampling units. Based on this, sampling the demura value corresponding to 5 driving voltages for each emission color of each of sampling units of the present disclosure, for example, taking the red sub-pixel as an example as shown in FIG. 4*b*, determining 5 theoretical driving voltage x1, x2, x3, x4, and x5, wherein x2=V1, x4=V2, x1<x2<x3<x4<x5, determining a brightness L1 corresponding to the theoretical driving voltage x1 according to the gamma curve to drive the display panel to emit light, recording the actual driving voltage T1 when the output brightness of the corresponding sub-pixel reaches L1 (average brightness of the sampling unit) to obtain the correspondence between the theoretical driving voltage x1 of the red sub-pixel and the actual driving voltage T1, and in turn obtaining correspondences between the theoretical driving voltage x2, x3, x4, and x5 of the red sub-pixel and actual driving voltages T2, T3, T4, and T5, obtaining correspondences between the theoretical driving voltages x1, x2, x3, x4, and x5 of green sub-pixels and actual driving voltages T6, T7, T8, T9, and T10, and obtaining correspondences between the theoretical driving voltages x1, x2, x3, x4, and x5 of blue sub-pixels and actual driving voltages T11, T12, T13, T14, and T15. In this way, each of sampling units corresponds to 15 demura data. Since each of compression units includes 64 sampling units, the number of demura data blocks of each of compression units is also 15, and each of demura data blocks including demura data corresponding to 64 sampling units. For example, an identifier of the 15 demura data blocks of the compression unit i (i is an identifier of the compression unit, and the corresponding compression unit can be uniquely determined in the display panel according to the identifier) is R-1-i, R-2-i, R-3-i, R-4-i, R-5-i, G-1-i, G-2-i, G-3-i, G-4-i, G-5-i, B-1-i, B-2-i, B-3-i, B-4-i, B-5-i; the demura data block R-1-i in turn includes a correspondence between a theoretical driving voltage x1 (minimum brightness) of the red sub-pixel of the 64 sampling units of the compression unit i and the actual driving voltage T1, the demura data block R-2-i in turn includes a correspondence between a theoretical driving voltage x2 of the red sub-pixel of the 64 sampling units of the compression unit i and the actual driving voltage T2, and so on.

In order to reduce the data, sequentially compressing the 15 demura data blocks R-1-i, R-2-i, R-3-i, R-4-i, R-5-i, G-1-i, G-2-i, G-3-i, G-4-i, G-5-i, B-1-i, B-2-i, B-3-i, B-4-i, B-5-i, because the actual data size of each demura data block R (G/B)-1 (2/3/4/5)-i are different and will be changed, and the compressed data sizes of each of demura data blocks are also different after the corresponding compression, then in theory, only after the decoding of the compressed data of the current demura data block is completed, can we know the starting position of the compressed data of the next demura data block, that is, the compressed data of the demura data block can only be serially decoded, and this method requires a long decoding time. In response to this problem, the embodiments of the present disclosure provide a solution for parallelly decoding the compressed data of the demura data block. Correspondingly, the present disclosure improves the storage method of the compressed de-marking data. The compressed de-marking data includes the de-marking data after compressing and identifiers for identifying the location of each of the de-marking data after compressing, as shown in FIG. 4*c*, in order to facilitate distinction, marking the demura data block R(G/B)-1(2/3/4/5)-i after compression as R (G/B)-1(2/3/4/5)-i-Y, marking the position identifier that demura data block R(G/B)-1 (2/3/4/5)-I-Y as R(G/B)-1(2/3/4/5)-i-Z, wherein R can be replaced for G or B, 1 can be replaced by any one of 2 to 5. In FIG. 4*c*, the de-marking data after compressing and the identifier appear alternately, and in other embodiments of the present disclosure, the compressed de-marking data includes a header file that includes the identifier R(G/B)-1(2/3/4/5)-i-Z used to identify of each compressed data R(G/B)-1(2/3/4/5)-i-Y of all the compression units of the display panel, etc. That is, storing the identifier in a unified manner first, and then starting compressing the storage of data, or by other arbitrary methods.

In one embodiment, types of the de-marking data after compressing includes the light emission color (1 of R, G, and B) and the light intensity (1 of 1 to 5); the length of the identifier may be the same, for example, fixed it is 20 bytes long, the first 16 bytes are used to record the position, and the last 4 bytes are used to record the type.

In one embodiment, this step may call a corresponding number of decoding modules according to the total number of types of de-marking data, in which case each of decoding modules is configured to decode one type of de-marking data; or calling a corresponding number of decoding modules according to each display position of the total number of compression units, and at this time, each of decoding modules is configured to decode the de-marking data of one compression unit, and so on. The following description uses the example of calling the corresponding number of decoding modules according to the total number of types of de-marking data as an example, and other schemes and types thereof will not be described in detail.

In one embodiment, for 8K products, 15 decoding modules are called to execute the present disclosure, for example, decoding module 3-01 to decoding module 3-15 are called to execute the present disclosure, and the decoding module **3-*i*** is implemented by hardware.

In one embodiment, the step of based on the identifier data, obtaining an actual de-marking data after compressing of each of the display units in the current display position by the at least two decoding modules in parallel decoding the compressed de-marking data corresponding to a current display position in the RAM includes: establishing a mapping relationship between the decoding module and the de-marking data type; reading the compressed de-marking data corresponding to the current display position in the memory; and the decoding module parallel decoding the de-marking data corresponding to the type of de-marking data in each of decoding modules in the memory according to the identifier and the mapping relationship. As shown in FIG. 4*d*, the type of de-marking data corresponding to the decoding module 3-01 is R-1, and the type of de-marking data corresponding to the decoding module 3-15 is B-5.

In one embodiment, the step of the decoding module parallel decoding the de-marking data corresponding to the type of de-marking data in each of decoding modules of the memory according to the identifier and the mapping relationship includes: determining a position and a type of the compressed de-marking data in the de-marking data after compressing of each of the display units according to the identifier; parallel decoding the compressed de-marking data corresponding to the type of de-marking data by the decoding module according to the position and the type of the de-marking data after compressing of each of the display units. For example, by analyzing 20-byte content of the identifier, the position and type of the de-marking data can be obtained after compressing, and can parallel perform analyzing on this basis.

In one embodiment, the step of parallel decoding the compressed de-marking data corresponding to the type of de-marking data by the decoding module according to the position and the type of the de-marking data after compressing of each of the display units includes: performing data interception to the compressed de-marking data to obtain the de-marking data after compressing according to the position of de-marking data after compressing of each of display units of the compressed de-marking data, allocating the de-marking data after compressing to the corresponding decoding module according to the type of the de-marking data after compressing of each of display unit of the compressed de-marking data; and using the decoding module to decode the distributed de-marking data after compressing. For example, the memory intercepting the compressed de-marking data according to the position of the de-marking data after compressing of each of display units in the compressed de-marking data to obtain the de-marking data after compressing, and then sends the de-marking data after compressing to the decoding module to perform decoding, in one embodiment, data interception is performed by memory.

In one embodiment, the step of parallel decoding the compressed de-marking data corresponding to the type of de-marking data by the decoding module according to the position and the type of the de-marking data after compressing of each of the display units includes: allocating the position of the de-marking data after compressing of each of the display units in the compressed de-marking data to the corresponding decoding module; performing data interception on the compressed de-marking data by using the decoding module according to the position of the de-marking data after compressing of each of the display units in the compressed de-marking data to obtain the de-marking data after compressing and decode it. For example, the memory allocates the positions of the de-marking data after compressing of each of the display units in the compressed de-marking data to the corresponding decoding module, and then uses the decoding module performing data interception on the compressed de-marking data by using the decoding module according to the position of the de-marking data after compressing of each of the display units in the compressed de-marking data to obtain the de-marking data after compressing and decode it. In the present disclosure, data interception performed by decoding module.

In one embodiment, the step of determining the position and the type of the de-marking data after compressing of each of the display units of the compressed de-marking data according to the identifier includes: analyzing an identifier storage field of the compressed de-marking data to obtain the identifier corresponding to de-marking data after compressing; determining the position and the type of the compressed de-marking data in the de-marking data after compressing of each of the display units according to the content of the identifier after decoding. For example, set a header field as the identifier storage field in the compressed de-marking data, after decompressing the header field, all the identifiers can be obtained. According to the content of each of the identifiers, locations and types of all the de-marking data after compressing can be determined.

In one embodiment, the step of determining the position and the type of the de-marking data after compressing of each of the display units of the compressed de-marking data according to the identifier includes: analyzing the current identifier to obtain content of the current identifier; determining a position of the next identifier and a type of de-marking data after compressing corresponding to the next identifier according to the content of the current identifier; determining the position of the de-marking data after compressing corresponding to the next identifier according to the position of the next identifier and a content length of the next identifier. For example, if the length of each identifier is 20 bytes, then increasing the position of the next identifier by 20 bytes is the position of the de-marking data after compressing corresponding to the next identifier.

In one embodiment, the step of determining the position and the type of the de-marking data after compressing of each of the display units of the compressed de-marking data according to the identifier includes: analyzing the current identifier to obtain content of the current identifier; determining a position of the next identifier according to the content of the current identifier; determining a position of the de-marking data after compressing corresponding to the next identifier according to a position of the next identifier and a content length of the next identifier, determining a type of the de-marking data after compressing corresponding to the next identifier according to a content of the next identifier and a storage order of different types of the de-marking data after compressing of each of the display units of the compressed de-marking data. For example, if the length of each of the identifiers is 20 bytes, then increasing the position of the next identifier by 20 bytes is the position of the de-marking data after compressing corresponding to the next identifier. For example, the content of the next identifier includes compression order number, because the storage order of the de-marking data is R-1-i, R-2-i, R-3-i, R-4-i, R-5-i, G-1-i, G-2-i, G-3-i, G-4-i, G-5-i, B-1-i, B-2-i, B-3-i, B-4-i, B-5-I and sequentially compression, the type can be determined according to the compression order number and storage order.

In one embodiment, as shown in FIG. 4*d,* 15 decoding modules are using to decode 15 types of data at the same time, but because of variable-length encoding, lengths of each of data blocks are uncertain, and needs to add identifiers in front of each of data blocks. When decoding, an identifier jump module first reads a position of the identifier R-2-i-Z from the identifier R-1-i -Z, and a first decoding module 3-01 decoding the identifier R-2-i-Z, at the same time, the memory can extract R-2-i-Y from the identifier R-2-i-Z and give it to the second decoding module 3-02, and obtaining the position of the identifier R-3-i-Z at the same time, and so on. By jumping through the instructions of 15 identifiers, 15 decoding modules can work simultaneously.

Now analyze the benefits of the embodiments of the present disclosure: For an 8K panel with a 60 Hz refresh rate, the industry commonly uses a clock frequency of 594 MHz, and the fastest case per 16 lines of the display screen is only 30720 clock cycles, that is, average of decompression of each of the data blocks R(G/B)-1(2/3/4/5)-i-Y only 68 (30720'30÷15) clock cycles. Because the compression uses variable-length encoding, it is necessary to process the previous data to know the starting position of the next data, and each data block will have up to 64 data (data for each of the sampling units), which is that in the worst case scenario to take data, it takes up to 64 clocks. If calculating the conversion operation that needs to be done after the data is taken, it will exceed the limit of 68 clock cycles, which will not realize the real-time processing function. The present disclosure jumps through the instructions of 15 identifiers, that is, 15 decoding modules can work at the same time, and the limit of the clock cycle corresponding to each of the data blocks is also relaxed from 68 to 1024 (30720÷30), which can make the demura compressed data be decompressed in real time of the 8K panel, thereby reducing hardware costs and production time.

In one embodiment, after obtaining the actual de-marking data of each of the display units, for a certain light emission color of a sampling unit, an average driving voltage (theoretical value) xp of all sub-pixels of the light emission color of the sampling unit in the next display frame can be calculated, and then determining a gray scale area corresponding to the average driving voltage (theoretical value) xp, and then calling the correspondence with calculate an actual driving voltage corresponding to the average driving voltage (theoretical value) xp, then obtaining the demura data (xp−Tx) corresponding to the light-emitting color of the sub-pixel in the sampling unit, on this basis, determining an actual driving voltage V (V=x+xp−Tx) of each of sub-pixels according to a sum of the theoretical driving voltage (theoretical value) x and demura data (xp−Tx) for each of the sub-pixels T to complete the demura function.

Figure 2:
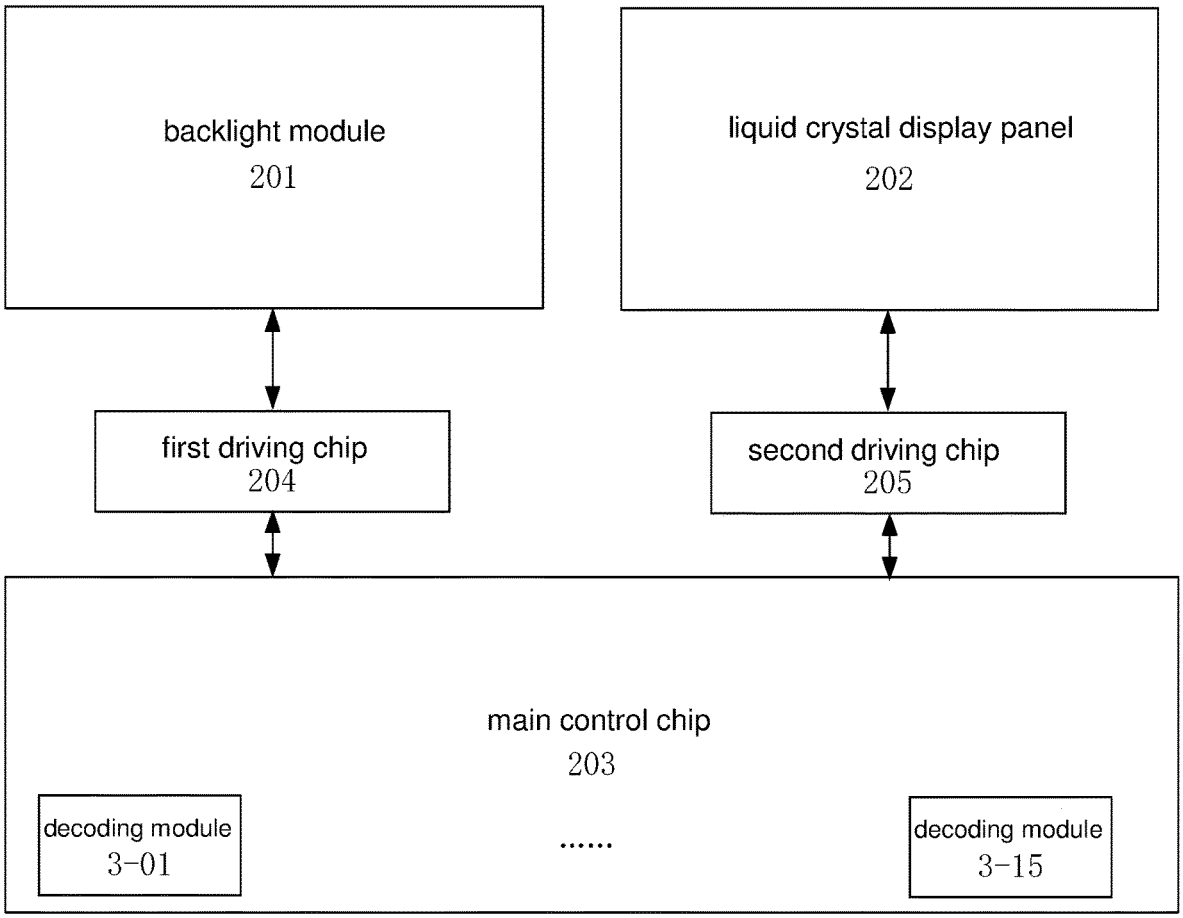
FIG. 2 is a schematic diagram of modules of the display device of one embodiment of the present disclosure.

In one embodiment, as shown in FIG. 2, the display device provided by the embodiment of the present disclosure includes: a backlight module 201, a liquid crystal display panel 202, and a main control chip 203. The backlight module includes a first driving chip 204, the liquid crystal display panel includes a second driving chip 205; the backlight source of the backlight module includes a plurality of backlight units arranged in an array and a driving circuit corresponding to each of the backlight units, the liquid crystal display panel includes a plurality of display units arranged in an array, each of the display units comprises a plurality of pixels, and the plurality of backlight units are in a one-to-one correspondence with the plurality of display units, wherein:

the main control chip acquiring a brightness data of each of the pixels of a target display unit when displaying a target display frame, determining a noise data of an image to be displayed of the target display unit when displaying the target display frame according to the brightness data of each of the pixels of the target display unit, and determining a target brightness value of the target backlight unit corresponding to the target display unit when displaying the target display frame according to the brightness data of each of the pixels of a target display unit and the noise data of the image to be displayed of the target display unit; determining a driving voltage value of the target backlight unit when displaying the target display frame according to the target brightness value of the target backlight unit corresponding to the target display unit when displaying the target display frame, and sending the driving voltage value to the first driving chip; determining a driving voltage value of each of the pixels of the target display unit when displaying the target display frame according the brightness data of each of the pixels of a target display unit when displaying a target display frame, and sending to the second driving chip;

the first driving chip driving each of the backlight units of the backlight module to emit light according to the driving voltage value of the target backlight display unit when displaying the target display frame; and the second driving chip driving each of the pixels of each of the display units of the liquid crystal display panel to transmit light according to the driving voltage value of each of the pixels of the target display unit when displaying the target display frame In one embodiment, the main control chip is configured to:

sequentially traverse each of the pixels of the target display unit according to traversal parameters to obtain a plurality of traversal blocks;

determine a total brightness value of all of the pixels of each of the traversal blocks according to the brightness data of each of the pixels of the target display unit; and determine the noise data of the image to be displayed of the target display unit when displaying the target display frame according to the determining method of the noise data corresponding to the target display unit and the total brightness value of all of the pixels of each of the traversal blocks.

In one embodiment, the main control chip is configured to:

determine an average brightness value of the plurality of pixels of the target display unit according to the brightness data of each of the pixels of the target display unit;

determine a threshold parameter corresponding to the target display unit according to the average brightness value of the plurality of pixels of the target display unit; and obtain the determining method of the noise data corresponding to the target display unit according to a preset determining method of the noise data corresponding to the target display unit and the threshold parameter corresponding to the target display unit.

In one embodiment, the main control chip is configured to:

set the noise data of the image to be displayed by the target display unit to a first value when a sum of brightness values of all pixels in all traversal blocks is less than a first threshold;

set the noise data of the image to be displayed by the target display unit to a second value when the sum of the brightness values of all pixels in any one traversal block is greater than a second threshold; and set the noise data of the image to be displayed by the target display unit to a third value when the sum of brightness values of all pixels in all traversal blocks is less than the second threshold, and the sum of brightness values of all pixels in any one traversal block is greater than the first threshold.

In one embodiment, the main control chip is configured to:

filter all the traversal blocks to find a target traversal block which the sum of the brightness values of all pixels is less than the second threshold and greater than the first threshold; and determine the third value according to the sum of the brightness values of the target traversal block.

In one embodiment, the main control chip is configured to:

filter all the traversal blocks to find a target traversal block which the sum of the brightness values of all pixels is greatest; and determine the third value according to the sum of the brightness values of the target traversal block.

In one embodiment, the main control chip is configured to:

determine an average brightness value and a maximum brightness value of the plurality of pixels of the target display unit according to the brightness data of each of the pixels of the target display unit; and determine the target brightness value of the target backlight unit corresponding to the target display unit when displaying the target display frame according to the average brightness value, the maximum brightness value, and the noise data.

In one embodiment, the main control chip is configured to:

determine a compensated brightness value according to the average brightness value and the maximum brightness value; and determine the target brightness value of the target backlight unit corresponding to the target display unit when displaying the target display frame according to the average brightness value, the compensated brightness value, and the noise data.

In one embodiment, the main control chip is configured to:

determine a brightness difference value according to the average brightness value and the maximum brightness value; and determine the compensated brightness value according to the brightness difference value and a preset compensation method.

In one embodiment, the main control chip is configured to:

read a compressed de-marking data stored in a memory in a compressed state and load it into a RAM, the compressed de-marking data comprises de-marking data after compressing for each of the display units, and an identifier data configured to identify locations of each of the de-marking data after compressing;

use at least two decoding modules, based on the identifier data, by the at least two decoding modules in parallel decoding the compressed de-marking data corresponding to a current display position in the RAM, to obtain an actual de-marking data of each of the display units in the current display position; and determine the driving voltage value of each of the pixels of the target display unit when displaying the target display frame, and send to the second driving chip according to the brightness data of each of the pixels and the actual de-marking data.

The present disclosure will be described by an 8K resolution display device as an example.

In one embodiment, the backlight of the backlight module is composed of 12 backplanes, each of the backplanes includes 432 partitions, each of the partitions has 4 LED lights connected in series, and the 4 LED lights are driven by a driving circuit to form a backlight unit, for example, 12 light bars are arranged in parallel, each of the light bar includes 8*54 backlight units, and 4 LED lights correspond to one display unit of the liquid crystal display panel; each of the display units of the liquid crystal display panel includes 80*80 pixels, and the size of each of the traversal blocks is 5*5 pixels.

On this basis, for how to calculate the brightness value of the backlight unit, the traversal method shown in FIG. 5*a* is used to traverse the display image (80*80 pixels) of the display unit corresponding to each of the backlight units, and will get 79*79 (that is, N in FIG. 5*b*) traversal blocks, for obtaining a total brightness value $L_{block}$ corresponding to each of the traversal blocks, adding the brightness values of each of the traversal blocks of all pixels, and determining a noise data ra corresponding to the backlight unit according to a noise data determination method shown in FIG. 5*b*, and then determining the target brightness value of the backlight unit according to the target brightness value determination method shown in FIG. 5*c*.

Specifically, in the calculation methods shown in FIGS. 5*b* to 5*c:*

$L_{ave}$ is an average brightness value of all pixels in the target display unit corresponding to the target backlight unit, $L_{max}$ is a maximum brightness value of all pixels in the target display unit corresponding to the target backlight unit, $L_{dif}$ is a brightness difference value of all pixels in the target display unit corresponding to the target backlight unit, f(x) is a compensation brightness value corresponding to the backlight unit, $BL_{val}$ is a target brightness value corresponding to the target backlight unit.

In the determination method shown in FIG. 5*b*, display devices of different specifications correspond to different thresholds th1 and th2, and a sum of brightness values of all pixels in all traversal blocks is less than a first threshold, setting the noise data of the image to be displayed by the target display unit to a first value, that is ra=1;

setting the noise data of the image to be displayed by the target display unit to a second value when the sum of the brightness values of all pixels in any one traversal block is greater than a second threshold, that is, ra=0; and setting the noise data of the image to be displayed by the target display unit to a third value when the sum of brightness values of all pixels in all traversal blocks is less than the second threshold, and the sum of brightness values of all pixels in any one traversal block is greater than the first threshold, that is ra is a value between 0 and 1, such as 0.5.

At the same time, if the image of the backlight unit corresponding to the display unit in a dark state and there is a small amount of noise, then a sum of the brightness values $L_{block}$ corresponding to all traversal blocks is less than the threshold th1, and the noise data ra is 1, on this basis, as shown in FIG. 5*c*, the target brightness value of the backlight unit is the same as the average brightness value, that is $BL_{val}=L_{ave}$, the introduction of noise can be reduced by a coefficient of ra, especially for the scene with a black screen but a little white noise, the value $L_{ave}$ is very small, which is almost zero, at this time can just turn off the corresponding backlight unit directly.

Regarding how to convert the driving voltage value of the backlight unit, it is assumed that the real output brightness level of the LED of the backlight unit of 8K resolution has a 4096 level, that is, the second bit-width is 12 bit-width. At the same time:

First, measuring and capturing the brightness value of LED at each level of driving voltage from 0 to 4095, Lm[m=0-4095], and normalizing the data to obtain Lmv [m=0-4095].

According to the input image content, the brightness value is calculated by 8 bit (that is, the first bit-width is 8 bit), $BL_{val}$ is the digital signal has only 256 levels of 0 to 255 level.

For 8 bit data, normalizing data of the simulated gamma curve, according to the formula:

$$Lga(n)=(n/255)\hat{}ga;$$

wherein, n=0 to 255, ga=2.2(which is adjustable);

Traversal brightness Lmv[m=0-4095], finding the brightness of each brightness of Lga(n) and the most luminance approximate LED; obtaining the driving voltage conversion table, the first bit-width driving voltage value and the second bit-width driving of the correspondence between the voltage values are as follows:

a brightness of Lga (0) is approximately equal to a brightness of LED Lmv [0], which is 0 map (corresponding) 0;

a brightness of Lga (1) is approximately equal to a brightness of LED Lmv [3], which is 1 map 3;

a brightness of Lga (2) is approximately equal to a brightness of LED Lmv [7], which is 2 map 7;

a brightness of Lga (3) is approximately equal to a brightness of LED Lmv [14], which is 3 map 14;

a brightness of Lga (4) is approximately equal to a brightness of LED Lmv [22], which is 4 map 22;

. . .

a brightness of Lga (255) is approximately equal to a brightness of LED Lmv [4095], which is 255 map 4095.

Figure 5D:
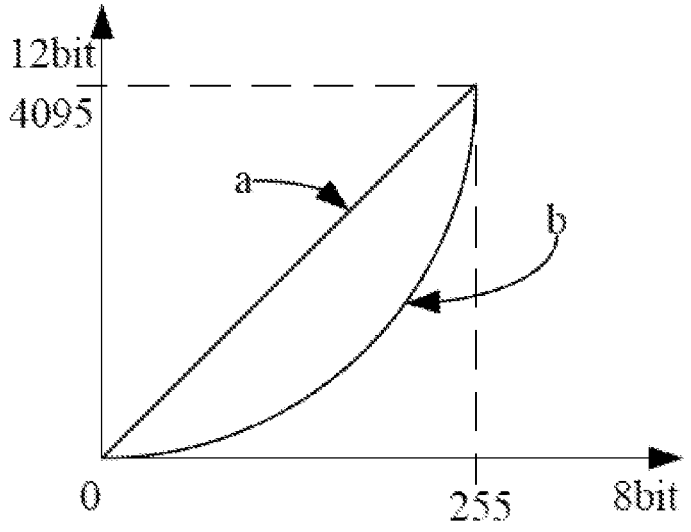

Based on the above correspondence, the driving voltage correspondence shown in FIG. 5*d* can be drawn. As shown in FIG. 5*d*, if the 8-bit bit-width is directly converted into the 12-bit bit-width, a correspondence curve a between the two different bit-width driving voltages is a straight line (1 corresponds to 16, 2 corresponds to 32, etc.), and a correspondence curve b based on the brightness and the driving voltage which according to the above correspondence is a gamma curve, which is more suitable for the display effect of the LED, the conversion of the driving voltage value based on correspondence curve b can achieve a better display effect.

In the above embodiments, the description of each of the embodiments has its own emphasis. For a part that is not detailed in one embodiment, can be refer to related descriptions in other embodiments.

The display device driving method and the display device provided in the embodiments of the present disclosure are described in detail above. Specific embodiments are used in the specification to explain the principles and implementation of the present disclosure. The descriptions of the above embodiments are only used to help understanding the technical solutions and the core ideas of the present disclosure; those of ordinary skill in the art should understand that they can still modify the technical solutions described or equivalently replace some of the technical features in the foregoing embodiments, these modifications or replacements of the corresponding technical solutions does not deviate from the scope of the technical solutions of the embodiments of the present disclosure.

What is claimed is:

1. A display device driving method, wherein the display device comprises a backlight module, a liquid crystal display panel, and a main control chip, the backlight module comprises a first driving chip, the liquid crystal display panel comprises a second driving chip, a backlight source of the backlight module comprises a plurality of backlight units arranged in an array and a driving circuit corresponding to each of the backlight units, the liquid crystal display panel comprises a plurality of display units arranged in an array, each of the display units comprises a plurality of pixels, the plurality of backlight units are in a one-to-one correspondence with the plurality of display units, and the display device driving method comprises following steps:

the main control chip acquiring a brightness data of each of the pixels of a target display unit when displaying a target display frame, determining a noise data of an image to be displayed of the target display unit when displaying the target display frame according to the brightness data of each of the pixels of the target display unit, and determining a target brightness value of a target backlight unit corresponding to the target display unit when displaying the target display frame according to the brightness data of each of the pixels of the target display unit and the noise data of the image to be displayed of the target display unit;

the main control chip determining a driving voltage value of the target backlight unit when displaying the target display frame according to the target brightness value of the target backlight unit corresponding to the target display unit when displaying the target display frame, and sending the driving voltage value to the first driving chip;

the main control chip determining a driving voltage value of each of the pixels of the target display unit when displaying the target display frame according the brightness data of each of the pixels of the target display unit when displaying the target display frame, and sending the driving voltage value to the second driving chip;

the first driving chip driving each of the backlight units of the backlight module to emit light according to the driving voltage value of the target backlight unit when displaying the target display frame; and the second driving chip driving each of the pixels of each of the display units of the liquid crystal display panel to transmit light according to the driving voltage value of each of the pixels of the target display unit when displaying the target display frame; wherein the step of determining the noise data of the image to be displayed of the target display unit when displaying the target display frame according to the determining method of the noise data corresponding to the target display unit and the total brightness value of all of the pixels of each of the traversal blocks further comprises:

setting the noise data of the image to be displayed by the target display unit to a first value when a sum of brightness values of all of the pixels in all of the traversal blocks is less than a first threshold;

setting the noise data of the image to be displayed by the target display unit to a second value when the sum of the brightness values of all of the pixels in any one traversal block is greater than a second threshold; and setting the noise data of the image to be displayed by the target display unit to a third value when the sum of brightness values of all of the pixels in all of the traversal blocks is less than the second threshold, and the sum of brightness values of all of the pixels in any one traversal block is greater than the first threshold; wherein the step of setting the noise data of the image to be displayed by the target display unit to the third value comprises:

filtering all of the traversal blocks to find a target traversal block which the sum of the brightness values of all of the pixels is less than the second threshold and greater than the first threshold; and determining the third value according to the sum of the brightness values of the target traversal block.

2. The display device driving method as claimed in claim 1, wherein the step of determining the noise data of the image to be displayed of the target display unit when displaying the target display frame according to the brightness data of each of the pixels of the target display unit comprises:

sequentially traversing each of the pixels of the target display unit according to traversal parameters to obtain a plurality of traversal blocks;

determining a total brightness value of all of the pixels of each of the traversal blocks according to the brightness data of each of the pixels of the target display unit; and determining the noise data of the image to be displayed of the target display unit when displaying the target display frame according to a determining method of the noise data corresponding to the target display unit and the total brightness value of all of the pixels of each of the traversal blocks.

3. The display device driving method as claimed in claim 2, wherein before the step of determining the noise data of the image to be displayed of the target display unit when displaying the target display frame according to the determining method of the noise data corresponding to the target display unit and the total brightness value of all of the pixels of each of the traversal blocks further comprises:

determining an average brightness value of the plurality of pixels of the target display unit according to the brightness data of each of the pixels of the target display unit;

determining a threshold parameter corresponding to the target display unit according to the average brightness value of the plurality of pixels of the target display unit; and obtaining the determining method of the noise data corresponding to the target display unit according to a preset determining method of the noise data corresponding to the target display unit and the threshold parameter corresponding to the target display unit.

4. The display device driving method as claimed in claim 1, wherein the step of setting the noise data of the image to be displayed by the target display unit to the third value comprises:

filtering all of the traversal blocks to find a target traversal block which the sum of the brightness values of all of the pixels is greatest; and determining the third value according to the sum of the brightness values of the target traversal block.

5. The display device driving method as claimed in claim 1, wherein the step of determining the target brightness value of the target backlight unit corresponding to the target display unit when displaying the target display frame according to the brightness data of each of the pixels of the target display unit and the noise data of the image to be displayed of the target display unit comprises:

determining an average brightness value and a maximum brightness value of the plurality of pixels of the target display unit according to the brightness data of each of the pixels of the target display unit; and determining the target brightness value of the target backlight unit corresponding to the target display unit when displaying the target display frame according to the average brightness value, the maximum brightness value, and the noise data.

6. The display device driving method as claimed in claim 5, wherein the step of determining the target brightness value of the target backlight unit corresponding to the target display unit when displaying the target display frame according to the average brightness value, the maximum brightness value, and the noise data comprises:

determining a compensated brightness value according to the average brightness value and the maximum brightness value; and determining the target brightness value of the target backlight unit corresponding to the target display unit when displaying the target display frame according to the average brightness value, the compensated brightness value, and the noise data.

7. The display device driving method as claimed in claim 6, wherein the step of determining the compensated brightness value according to the average brightness value and the maximum brightness value comprises:

determining a brightness difference value according to the average brightness value and the maximum brightness value; and determining the compensated brightness value according to the brightness difference value and a preset compensation method.

8. The display device driving method according to claim 1, wherein the step of the main control chip determining the driving voltage value of each of the pixels of the target display unit when displaying the target display frame according the brightness data of each of the pixels of the target display unit when displaying the target display frame, and sending the driving voltage value to the second driving chip comprises:

reading a compressed de-marking data stored in a memory in a compressed state and loading it into a random access memory (RAM), the compressed de-marking data comprising de-marking data after compressing for each of the display units, and an identifier data configured to identify locations of each of the de-marking data after compressing;

using at least two decoding modules, based on the identifier data, obtaining an actual de-marking data after compressing of each of the display units in a current display position in the RAM by the at least two decoding modules in parallel decoding the compressed de-marking data corresponding to the current display position in the RAM; and determining the driving voltage value of each of the pixels of the target display unit when displaying the target display frame, and sending the driving voltage value to the second driving chip according to the brightness data of each of the pixels and the actual de-marking data.

9. A display device, comprising a backlight module, a liquid crystal display panel, and a main control chip, the backlight module comprising a first driving chip, the liquid crystal display panel comprising a second driving chip, a backlight source of the backlight module comprising a plurality of backlight units arranged in an array and a driving circuit corresponding to each of the backlight units, the liquid crystal display panel comprises a plurality of display units arranged in an array, each of the display units comprises a plurality of pixels, and the plurality of backlight units are in a one-to-one correspondence with the plurality of display units, wherein:

the main control chip acquires a brightness data of each of the pixels of a target display unit when displaying a target display frame, determines a noise data of an image to be displayed of the target display unit when displaying the target display frame according to the brightness data of each of the pixels of the target display unit, determines a target brightness value of a target backlight unit corresponding to the target display unit when displaying the target display frame according to the brightness data of each of the pixels of the target display unit and the noise data of the image to be displayed of the target display unit, determines a driving voltage value of the target backlight unit when displaying the target display frame according to the target brightness value of the target backlight unit corresponding to the target display unit when displaying the target display frame, and sends the driving voltage value to the first driving chip, and determines a driving voltage value of each of the pixels of the target display unit when displaying the target display frame according the brightness data of each of the pixels of the target display unit when displaying the target display frame, and sends the driving voltage value to the second driving chip;

the first driving chip drives each of the backlight units of the backlight module to emit light according to the driving voltage value of the target backlight unit when displaying the target display frame; and the second driving chip drives each of the pixels of each of the display units of the liquid crystal display panel to transmit light according to the driving voltage value of each of the pixels of the target display unit when displaying the target display frame; wherein the main control chip is configured to:

set the noise data of the image to be displayed by the target display unit to a first value when a sum of brightness values of all of the pixels in all of the traversal blocks is less than a first threshold;

set the noise data of the image to be displayed by the target display unit to a second value when the sum of the brightness values of all of the pixels in any one traversal block is greater than a second threshold; and set the noise data of the image to be displayed by the target display unit to a third value when the sum of brightness values of all of the pixels in all of the traversal blocks is less than the second threshold, and the sum of brightness values of all of the pixels in any one traversal block is greater than the first threshold; wherein the main control chip is configured to:

filter all of the traversal blocks to find a target traversal block which the sum of the brightness values of all of the pixels is less than the second threshold and greater than the first threshold; and determine the third value according to the sum of the brightness values of the target traversal block.

10. The display device as claimed in claim 9, wherein the main control chip is configured to:

sequentially traverse each of the pixels of the target display unit according to traversal parameters to obtain a plurality of traversal blocks;

determine a total brightness value of all of the pixels of each of the traversal blocks according to the brightness data of each of the pixels of the target display unit; and determine the noise data of the image to be displayed of the target display unit when displaying the target display frame according to a determining method of the noise data corresponding to the target display unit and the total brightness value of all of the pixels of each of the traversal blocks.

11. The display device as claimed in claim 10, wherein the main control chip is configured to:

determine an average brightness value of the plurality of pixels of the target display unit according to the brightness data of each of the pixels of the target display unit;

determine a threshold parameter corresponding to the target display unit according to the average brightness value of the plurality of pixels of the target display unit; and obtain the determining method of the noise data corresponding to the target display unit according to a preset determining method of the noise data corresponding to the target display unit and the threshold parameter corresponding to the target display unit.

12. The display device as claimed in claim 9, wherein the main control chip is configured to:

filter all of the traversal blocks to find a target traversal block which the sum of the brightness values of all of the pixels is greatest; and determine the third value according to the sum of the brightness values of the target traversal block.

13. The display device as claimed in claim 9, wherein the main control chip is configured to:

determine an average brightness value and a maximum brightness value of the plurality of pixels of the target display unit according to the brightness data of each of the pixels of the target display unit; and determine the target brightness value of the target backlight unit corresponding to the target display unit when displaying the target display frame according to the average brightness value, the maximum brightness value, and the noise data.

14. The display device as claimed in claim 13, wherein the main control chip is configured to:

determine a compensated brightness value according to the average brightness value and the maximum brightness value; and determine the target brightness value of the target backlight unit corresponding to the target display unit when displaying the target display frame according to the average brightness value, the compensated brightness value, and the noise data.

15. The display device as claimed in claim 14, wherein the main control chip is configured to:

determine a brightness difference value according to the average brightness value and the maximum brightness value; and determine the compensated brightness value according to the brightness difference value and a preset compensation method.

16. The display device as claimed in claim 9, wherein the main control chip is configured to:

read a compressed de-marking data stored in a memory in a compressed state and loading it into a random access memory (RAM), the compressed de-marking data comprises de-marking data after compressing for each of the display units, and an identifier data configured to identify locations of each of the de-marking data after compressing;

use at least two decoding modules, based on the identifier data, to obtain an actual de-marking data after compressing of each of the display units in a current display position in the RAM by the at least two decoding modules in parallel decoding the compressed de-marking data corresponding to the current display position in the RAM; and determine the driving voltage value of each of the pixels of the target display unit when displaying the target display frame, and send the driving voltage value to the second driving chip according to the brightness data of each of the pixels and the actual de-marking data.

* * * * *